United States Patent [19]

Van DeMotter

[11] 4,198,950

[45] Apr. 22, 1980

[54] DRESSING DEVICE FOR WHEELS OR THE LIKE

[76] Inventor: Charles P. Van DeMotter, 16104 Lucille Dr., Cleveland, Ohio 44111

[21] Appl. No.: 896,047

[22] Filed: Apr. 13, 1978

Related U.S. Application Data

[63] Continuation of Ser. No. 753,615, Dec. 22, 1976, abandoned.

[51] Int. Cl.[2] ..... B24B 53/08

[52] U.S. Cl. ..... 125/11 TP; 125/11 AT

[58] Field of Search ..... 125/11 R, 11 TP, 11 CC, 125/11 AT

[56] References Cited

U.S. PATENT DOCUMENTS

| | | | |
|---|---|---|---|
| 139,775 | 6/1873 | Cole | 125/11 TP |
| 2,197,762 | 4/1940 | Johnson | 125/11 AT |
| 2,303,715 | 12/1942 | Alvord | 125/11 AT |
| 2,304,970 | 12/1942 | Turner | 125/11 AT |
| 2,344,385 | 3/1944 | Beaudet | 125/11 TP |
| 2,485,311 | 10/1949 | Porcello | 125/11 AT |
| 2,665,680 | 1/1954 | Gotberg | 125/11 AT |

FOREIGN PATENT DOCUMENTS

| | | | |
|---|---|---|---|
| 1049984 | 1/1954 | France | 125/11 TP |
| 882999 | 11/1961 | United Kingdom | 125/11 TP |

*Primary Examiner*—Harold D. Whitehead

*Attorney, Agent, or Firm*—Watts, Hoffmann, Fisher & Heinke, Co.

[57] ABSTRACT

A dressing device for attachment to a machine of the type used for dressing, grinding and shaping operations on a wheel, or the like. A collar is attached to the frame or hub of a motor housing through which the spindle for the grinding wheel extends. The frame, or collar, carries a post on which a first slide is adjustably mounted. The first slide carries a bar on which a second slide may be adjustably mounted, and the second slide carries a dressing tool head. The head is turnable on a swivel and has a cam slot which serves as a cam guide for actuation of a dressing unit.

4 Claims, 9 Drawing Figures

DRESSING DEVICE FOR WHEELS OR THE LIKE

This is a continuation of application Ser. No. 753,615 filed Dec. 22, 1976, now abandoned.

BACKGROUND OF THE INVENTION

Heretofore, devices for dressing a grinding wheel have usually been mounted on a grinding machine to which the grinding wheel is brought for dressing the angle of the wheel. In some cases, the dressing tool is used as an attachment for the machine on which a cutter is being ground, but the difficulty has been to orient the path of travel of the dressing tool across the periphery of the grinding wheel and to obtain the correct shape for gullet forms on different shear angles. This is especially true where it is desired to obtain the same form from the first tooth to the last on the broach insert. In other instances, extensive mathematical computations and/or the use of templets in moving the tool through different selected curvilinear paths has been used in order to provide the curvature of a grinding wheel, or the like, to provide a true curvature to the workpiece, such as for example, when a form tool, such as a broach or the like, is ground there is provided a close tolerance uniformity between successive ground portions thereof, such as in the gullet from the first to the last tooth. Typical prior art apparatus and methods are illustrated in the following U.S. Pat. Nos. 1,686,802, 2,146,466, 2,178,135, 1,182,362, 2,158,423.

The invention of the present application has for an object the provision of an attachment device for a dressing, grinding or shaping machine. Preferably, the invention provides such device for a grinding machine, such as a broach grinder, which will produce uniformity from tooth-to-tooth and broach-to-broach, without removing the dresser from the machine. The invention provides a cam guide head and at least one adjustable slide. The cam head is swivelly mounted on the slide and locates the cam in an appropriate relationship to the wheel. The wheel is dressed by a tool which is carried in a holder, and the holder is adapted to be selectively moved back and forth along the cam to complete the dressing operation.

In the preferred form, the dressing device is mounted upon the frame or hub of the motor housing through which the grinding spindle extends. Thus, the dresser is always in position for dressing the wheel, and the operator can perform such dressing operation in any position, even while the machine is in motion. By this arrangement, increased operator output and reduction of wheel waste can be achieved without sacrifice in quality.

In the present invention, only one cam is required for all portions to be ground, such as gullet sizes. Proper setting of the diamond in the dressing unit automatically determines the size radius required for the desired pitch in the gullet to be ground. This arrangement is readily applied for gullet forms on different hook angles with minimum adjustment.

BRIEF DESCRIPTION OF THE DRAWINGS

FIG. 5*a* is a side elevational exploded view of a portion of the dressing head assembly shown in FIG. 5;

DESCRIPTION OF THE PREFERRED EMBODIMENT

Figure 1:
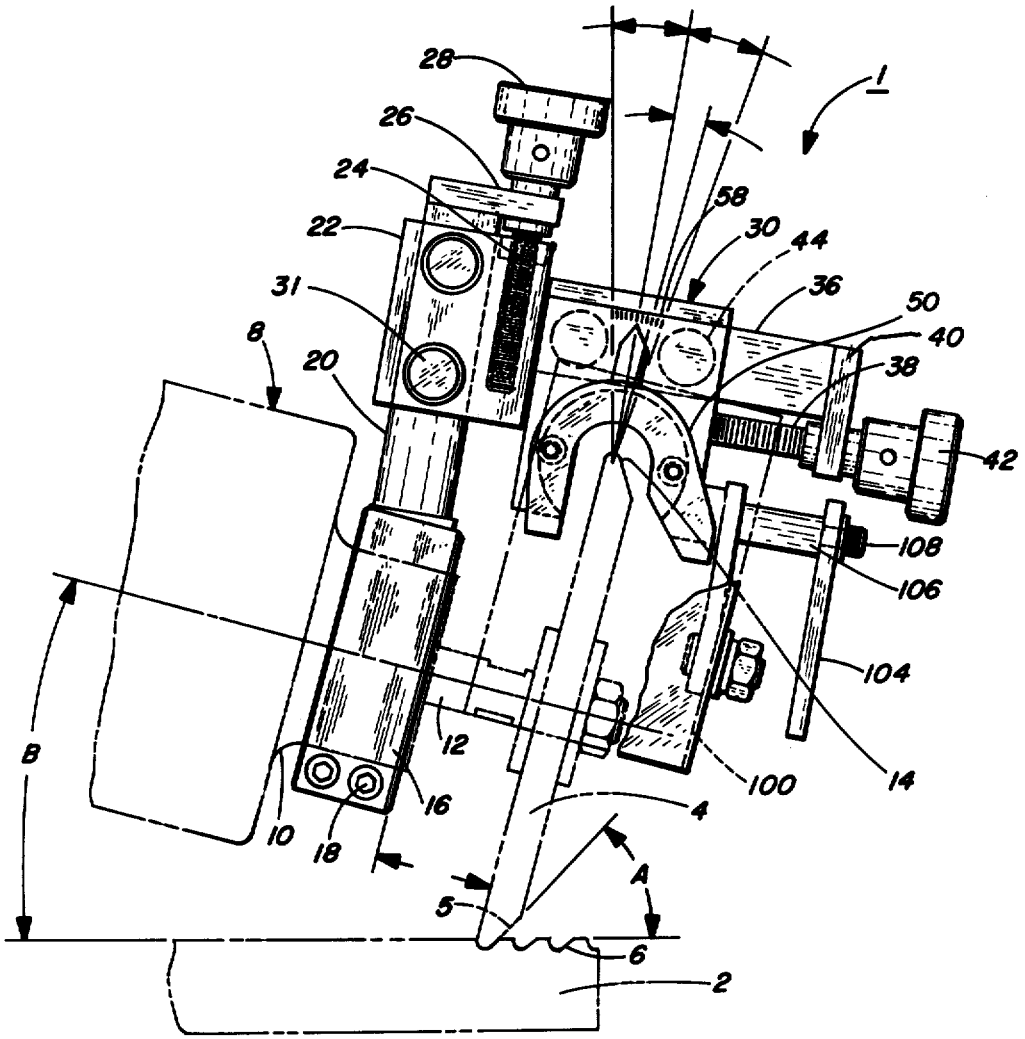
FIG. 1 is a front elevation of a dressing device embodying the invention of the present application.

Referring again to the drawings, and in particular to FIG. 1, there is illustrated generally the dressing device, designated generally at 1, in accordance with the invention. As shown, the device 1 is preferably employed for treating, such as by dressing, grinding, or otherwise shaping, a grinding wheel 4 for grinding a workpiece 2, such as a broach, broach insert, or the like. In such case, the surface 5 conforms to the hook angle, as at A, of the gullet 6 to be ground in the broach 2.

In the form shown, the longitudinal rotational axis of the grinding wheel 4 is inclined horizontally by an angle, as at B, which is defined herein as the hook angle of the gullet to be ground. For example, based on a standard 15° hook angle B, the back angle A in this form would be approximately 47°.

As seen, the grinding wheel 4 may be driven by an electric motor 8, which has an axially extending hub 10 through which a spindle 12 extends for supporting the grinding wheel 4. Significantly, the outermost peripheral portion of the grinding wheel is provided so as to have a curved surface 14 which corresponds to the bottom surface of the gullet to be ground.

In the invention, the dressing device includes a split-collar 16 adapted to extend around the hub so as to be secured thereto by threaded fasteners as at 18. The collar 18 mounts an upstanding post which, in the form shown, is slightly off-set vertically in relation to the general plane of the dressing wheel 4. A first slide member 22 is movably mounted on the post and its position, with reference to the collar 10, is controlled by an adjusting screw 24 which extends through an arm 26 attached to the post 20, and which terminates in an adjusting knob 28 for controlling movement of the slide member. By this arrangement, the dressing head assembly, indicated generally at 30, can be selectively adjusted generally radially in respect to the dressing wheel 4. T slide member 22 can be effectively locked in any selective adjusted position via fasteners, as at 31, which lock against the post 20.

Figure 5:
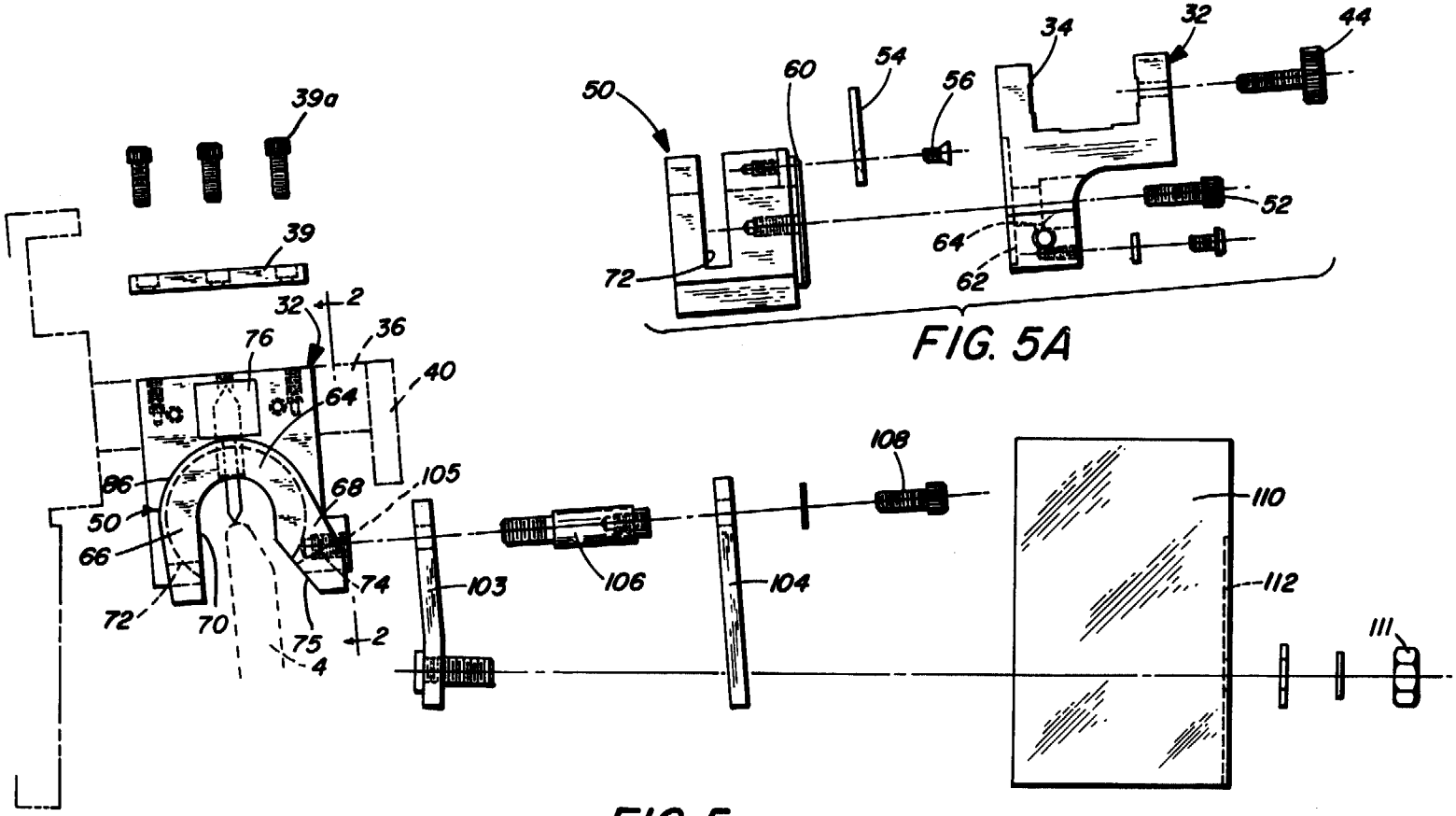
FIG. 5 is a front elevational veiw of the dressing head assembly with a guard attachment shown in an exploded view.

As best seen in FIGS. 5 and 5A, the dressing head assembly 30 includes a second slide member 32 for moving the dressing head assembly 30 transversely of the wheel 4. As shown, the slide member 32 has a generally U-shaped slot 34 adapted to receive a guide bar 36 (FIG. 1) which is fixedly secured to the first slide member 22. Horizontal actuation of the slide member 32 may be achieved by another threaded screw 38 (FIG. 1) which extends through a bracket plate 40 secured to the arm 36 and which is connected at its outer end to another knob 42 for controlling horizontal adjustment of the dressing head 30. Lock screws 44 may be provided for locking the slide member 32 to the bar 36 in any horizontal position, as desired. By this arrangement, the dressing device incorporates two slidable adjustments that form a double axis so that the head 30 may be moved up-and-down and/or horizontally so as to position the head in appropriate relationship for dressing operations in respect to the wheel 4. A cover 39 is threadably secured to the top of the slide member 32 by threaded fasteners 39*a*.

In the invention, the device includes a dressing head 50 which may be adjustably mounted on the slide member 32 via suitable adjustment screws, as at 52. The dressing head 50 mounts a pointer element 54 fixedly attached thereto by screw 56. By this arrangement, the dressing head 50 may be angularly rotated about a horizontal axis relative to the slide member 32 with the degree of angular orientation indicated by suitable indicia, as at 58, as seen in FIG. 1.

In the invention, the angular adjustment of the dressing head 50 is achieved by a circular projection 60 which slidably fits within a corresponding circular recess 62 provided in the confronting face of the slide member 32. The slide member 32 is provided with curved slots, as at 64, which receive the fasteners 52 (FIG. 5) to enable rotational movement of the dressing head 50 upon loosening of the fasteners 52 to provide angular adjustment of the dressing head 50.

Figure 3:
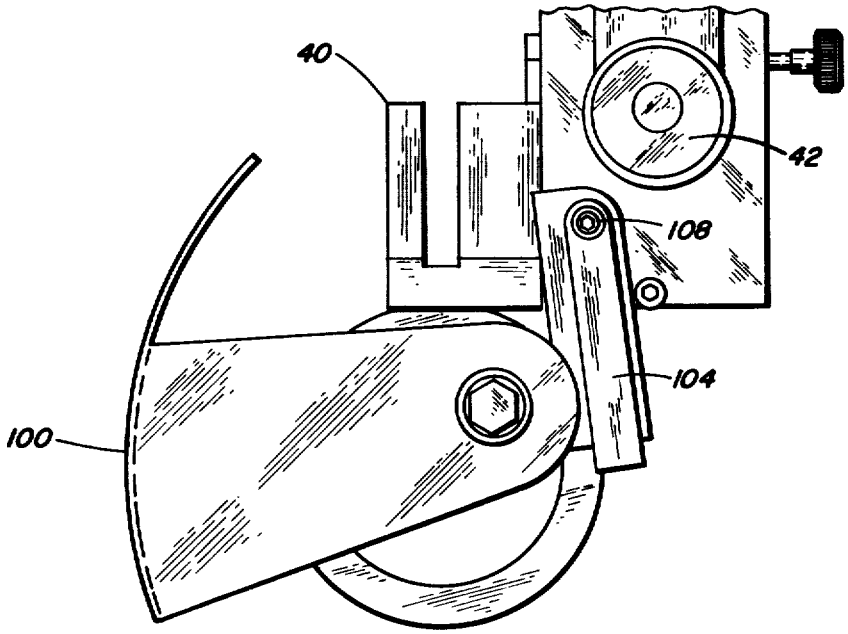
FIG. 3 is a side elevational view of the dressing device illustrated in FIG. 1.

In the invention, the dressing head 50 has a generally U-shaped configuration having a bight portion 64, a first arm 66 and a second arm 68 which extends tangentially with respect to the circular configuration of the bight portion 64. The portion 64, 66 and 68 together define a generally inverted U-shaped key-hole-like opening 70 (FIG. 3) which straddles the peripheral edge of the dressing wheel 5. The dressing head 50 is provided with a slot 72 which extends widthwise therethrough and which extends radially so as to terminate short of the terminal ends of the arms 66, 68 as at 72 and 74. The arm portion 68 has a tangential inner surface, as at 75, which merges into the inner generally inverted U-shaped configuration of the hole 70.

Figure 2:
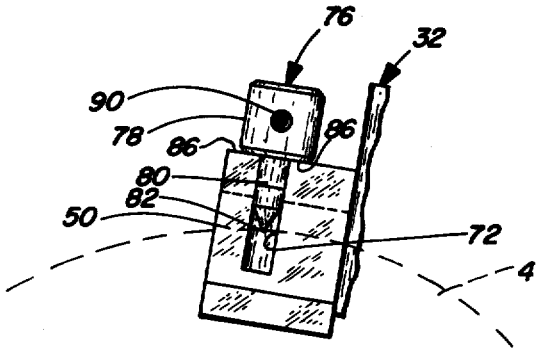
FIG. 2 is a side elevational view of a portion of the dressing device as seen along line 2—2 of FIG. 5.

In the invention, the dressing head 50 movably mounts a dressing element 76, (such as a diamond tool), which is mounted for radial movement in the slot 72, as best seen in FIG. 2. The element 76 includes a handle 78 with a stylus member 80 which mounts a diamond pointed tip, as at 82. In the invention, the bight portion 64 of the dressing head 50 provides a circular cam surface 86 disposed on either side of the slot 72 which provides a supporting track for the confronting under surfaces of the handle 78 so that the stylus 80 mounting the tip 82 may be radially adjusted manually in respect to the peripheral surface of the wheel 4 to be dressed. Preferably, the stylus 80 has a cross-sectional dimension so as to provide a close, smooth sliding fit within the slot 72 to insure a precision dressing of the wheel.

Figure 6:
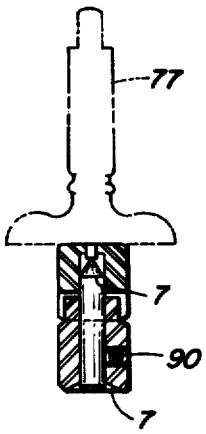
FIG. 6 is a section view of the set assembly for setting the dressing element.

In the invention, the stylus 80 may be axially adjusted within the handle 78 via a set-screw 90 (FIG. 6) so that the tip 82 can be controlled for the proper depth within the slot 72. For this purpose, a micrometer depth gauge 77 may be preset to the desired depth by inserting the gauge end, as at 81, into a set master 84 which is merely a cylindrical shell having an axial bore 85. With the set-screw 90 loosened, the stylus 80 is inserted into the set master and advanced until it contacts the micrometer. Then the set-screw 90 may be tightened so that the stylus is then correctly set and ready for use. For example, with a tooth pitch of 0.062 inches the depth reading would be 0.016 inches.

Figure 8:
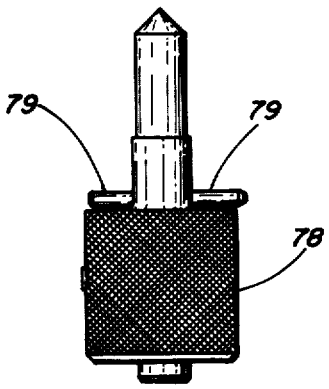
FIG. 8 is a fragmentary side view looking along the line 8—8 of FIG. 7.
Figure 7:
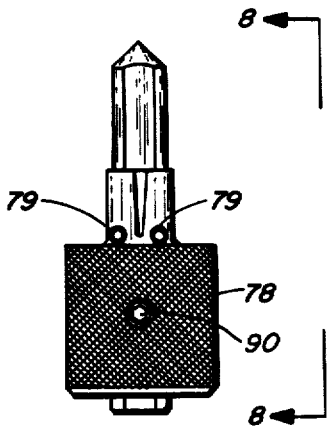
FIG. 7 is a side elevation view of the stylus of the dressing assembly.

In FIGS. 7 and 8, there is illustrated a modified version of the dressing element 76. In this form, the stylus 80 may be provided at its base with a polygonal, such as rectangular, guide block 91 which slidably fits within the slot 72 in the dressing head 50. By this arrangement, rotational movement of the stylus 80 about its longitudinal axis is minimized. Further, in this form one and preferably a pair of spaced, parallel guide pins 79 may be provided which extend through the guide block 91 adjacent the juncture of the connection of the guide block 91 with the handle 78. These pins 79 are preferably of a solid elongated cylindrical construction and provide a smooth camming coacting engagement with the confronting upper surfaces 86 (FIG. 2) of the dressing head 50.

Figure 4:
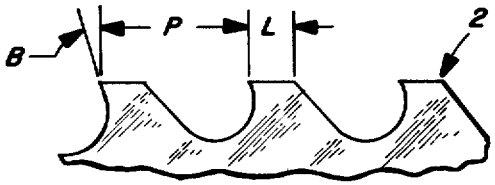
FIG. 4 is an enlarged, fragmentary view of a section of a broach insert to be dressed.

Referring again to FIG. 1 of the drawings, it will be seen that the dressing device of the invention incorporates a cam arrangement via dressing head 50 mounted on two adjustable slides that form a double axis. The vertical 28 and horizontal 42 knobs locate the cam slot 72 in the appropriate relationship to the wheel 4 to be dressed. By this arrangement, only the single cam slot 72 is required for all gullet sizes. The setting of the tip 82 determines the size radius required for the desired pitch. It readily adjusts for gullet forms on different shear angles. For example, in FIG. 4 there is illustrated a fragmentary, enlarged view of a broach insert 2. The hook angle is designated at B, the pitch at P, the land at L and the radius at R. For example, the back angle would be 47° based on a standard 15° hook angle B, as seen in FIG. 4. This provides a smaller back angle C of 10° maximum and a larger back angle D of 10° maximum based on a reference angle E of approximately 5°. The angle E is provided to afford proper clearance with the wheel to be dressed and constitutes the offset of the post 20 from the perpendicular relative to the longitudinal axis of the spindle 12. As a further example, the wheel 4 may have a diameter (O.D.) in the range from 4 to 7 inches with the wheel being spaced from the collar 16 at a distance F of approximately 1.75 inches minimum.

In the embodiment shown, the device may be provided with a guard assembly 100 which is attached to the slide member 32 (FIG. 5) by means of a guard arm assembly 102 (FIG. 1) for swingably mounting and locking the guard tangentially in respect to the dressing wheel 4. In other words, the guard assembly is moved radially in respect to the outer peripheral surface of the dressing wheel. As shown, the guard assembly includes an outer handle 104 which is lockably attached by means of a pin 106 (FIG. 5) and screw 108 to the slide member 32 via threaded aperture 105. The pin 106 is received through a slot 107 in an inner generally L-shaped arm 103 which is detachably connected to the guard plate 110 via a threaded screw and nut, as at 111, as best seen in FIG. 1. The guard plate 110 (FIG. 3) is of a curved construction and includes an inner, integral guard arm 112 which is detachably connected via the fastener 111 to the distal end of the arm 103. By this arrangement, the guard plate can be adjusted via screw 108 or fastener 111 so as to protect the operator during use of the device, as desired.

From the foregoing description and accompanying drawings, it will be seen that the present invention provides a novel wheel dressing and/or grinding attachment for use on a machine, such as a broach grinder-sharpener, which provides uniformity, for example, from tooth-to-tooth and broach-to-broach, without the need for removing the wheel from the machine. Moreover, the device can be used for all gullet sizes and readily adjusts for gullet forms on different shear angles.

I claim:

1. A dressing device for treating the abrasive wheel of a machine of the type used for grinding a broach or the like, comprising:

(a) a slide adapted to be detachably mounted on said machine;

(b) said slide being disposed for horizontal and vertical movement with relation to the rotational axis of a wheel to be treated;

(c) a head carried by said slide and mounted for movement about a first axis substantially tangent to a point near the periphery of said abrasive wheel, when said head is in its operative position, said axis being substantially parallel to the plane formed by said grinding wheel;

(d) adjustment means for selectively adjusting the position of said head relative to said slide;

(e) said head including a cam track member defining an outer cam surface having straight and arcuate portions, and having a cam slot formed therein, said cam track member forming a generally U-shaped aperture extending transverse to said head and having an imaginary axis substantially coincident with said first axis;

(f) said U-shaped aperture surface forming the same general shape relative to the grinding wheel as the shape to be formed in a work piece;

(g) a cam follower adapted to be disposed in said cam slot;

(h) said cam follower including a wheel dressing member adapted to be disposed in said cam slot for sliding arcuate and rectilinear movement, and for engaging the peripheral portion of a wheel to be treated; and, (i) guide means on said cam follower defining spaced cam track confronting surfaces on either side of the longitudinal axis of said dressing member, said guide means establishing spaced lines of contact between said cam follower and said outer cam surface on either side of the longitudinal axis of said dressing member.

2. A dressing device in accordance with claim 1, wherein:

(a) said head is off-set at an acute angle from the general plane of said wheel; and, (b) said dresser including a stylus member having a hardened pointed end and an enlarged handle portion.

3. Apparatus for dressing an abrasive wheel of a machine used in grinding and sharpening a broach or the like, comprising:

(a) a support member for detachably mounting the apparatus to the machine;

(b) a guide bar movably mounted to said support member, the position of said guide bar being adjustable in a direction substantially radial to the axis of rotation of said grinding wheel;

(c) a head assembly supported by said guide bar for movement in a direction substantially parallel to the axis of rotation of said grinding wheel, said head assembly including means for fixing its position along said slide member;

(d) said head assembly including a rotatably adjustable dressing head defining a substantially U-shaped aperture for receiving a portion of said grinding wheel and further defining an outer cam surface and a slot extending from said cam surface into said U-shaped aperture;

(e) a wheel dressing stylus assembly extending through said slot, said assembly including a stylus contactable with the periphery of said grinding wheel;

(f) said stylus assembly including a handle for grasping said stylus to effect movement in said assembly along said cam surface and further including a means for adjusting the distance between the stylus and the handle; and, (g) guide means on said stylus assembly defining spaced cam confronting guide surfaces on either side of the longitudinal axis of said stylus, said guide means establishing substantially spaced lines of contact between said stylus assembly and said cam surface on either side of the longitudinal axis of said stylus.

4. The apparatus of claim 3 wherein said guide means includes a pair of cylindrical shaped pins disposed in said stylus assembly on each side of the longitudinal axis of said stylus.

* * * * *